United States Patent [19]

Havel

[11] 4,066,449

[45] Jan. 3, 1978

[54] METHOD FOR PROCESSING AND DENSIFYING METAL POWDER

[76] Inventor: Charles J. Havel, 162 Proctor, Utica, N.Y. 13501

[21] Appl. No.: 602,221

[22] Filed: Aug. 6, 1975

Related U.S. Application Data

[62] Division of Ser. No. 509,723, Sept. 26, 1974, abandoned.

[51] Int. Cl.[2] ..... B22F 1/00

[52] U.S. Cl. ..... 75/211; 75/213; 75/226; 148/126

[58] Field of Search ..... 75/226, 200, 211, 213, 75/.5; 241/94; 148/126

[56] References Cited

U.S. PATENT DOCUMENTS

| | | | |
|---|---|---|---|
| 3,519,503 | 7/1970 | Moore et al. | 148/11.5 |
| 3,524,744 | 8/1970 | Parikh | 75/.5 C |
| 3,591,362 | 7/1931 | Benjamin | 75/211 X |
| 3,622,313 | 11/1971 | Havel | 75/226 |
| 3,639,179 | 2/1972 | Reichman et al. | 148/11.5 |
| 3,702,791 | 11/1972 | Freehe et al. | 148/11.5 |
| 3,776,704 | 12/1973 | Benjamin | 75/226 X |
| 3,802,938 | 4/1974 | Collins et al. | 148/126 |
| 3,874,938 | 4/1975 | Benjamin et al. | 148/126 X |
| 3,877,930 | 4/1975 | Volin | 75/211 X |
| 3,902,862 | 9/1975 | Moll et al. | 75/226 X |

*Primary Examiner*—Richard E. Schafer
*Attorney, Agent, or Firm*—McGlynn and Milton

[57] ABSTRACT

A method of producing a densified compact from a loose metal powder, the method comprising introducing strain into each particle of the loose metal powder to impart a residual stress to increase the potential energy level of the particles above the potential energy which the particles may have acquired during production thereof, the strain being introduced at a temperature below the recrystallization temperature thereof, and thereafter hot consolidating the loose metal powder.

8 Claims, 11 Drawing Figures

METHOD FOR PROCESSING AND DENSIFYING METAL POWDER

This is a division, of application Ser. No. 509,723 filed Sept. 26, 1974, now abandoned.

This invention relates to a method of processing powder metal to form powder metal compacts having superior mechanical and metallurgical properties than powder metal compacts formed by current commercial processes.

The use of sophisticated powder metallurgy techniques has become prevalent in the field of superalloys due to segregation problems encountered in conventional casting methods. Chemical homogeniety of highly complex alloy systems can be much more easily achieved by powder metallurgy techniques since segregation is limited to the volume of the powder particle. As used herein the field of superalloys emcompasses those materials which have been developed for high temperature - high stress service, specifically the nickel-base and cobalt-base superalloys. Although the process of the invention has particular application to the field of superalloys, this process may also be beneficially employed with other powder metals, such as titanium-base alloys and iron, copper, zinc, aluminum, refractory metals and alloy systems thereof.

Historically metal powders, such as ferrous-base alloys, have been densified by the two-step process of cold compaction and sintering. The superalloy powders, however, are not generally compressible because of their inherent strength. Therefore, cold compaction is not suitable for superalloy processing. The compaction of superalloy powders is generally performed hot, thus combining the compaction and sintering steps. Hot compaction is performed either by extrusion or by hot pressing. Powder extrusion involves canning the powder in a steel jacket and then hot extruding a powder billet, while hot pressing is accomplished by either hot isostatic pressing, vacuum hot pressing, or hot forging. These processes may be employed to form either a finished shape or rough stock for further hot forming.

As stated by Gerald J. Friedman and George S. Ansell in *THE SUPERALLOYS,* John Wiley and Sons, (New York, 1972), at page 429; "These hot-consolidation methods have one problem in common. Both compaction and sintering are in effect plastic-deformation processes, that is, densification and neck growth require shape changes under an applied stress. The very attributes that make superalloys technologically important, high temperature strength and oxidation resistance, make full densification and inter-particle bonding difficult to achieve even with the hot processing treatments. In order to produce strong, dense products, relatively high fractions of the homologous temperature must be used, coupled with extensive deformation."

The use of such high temperatures causes additional problems however. Upon subsequent heat treatment, it has been observed that, although intra-particle grain growth occurs as expected, grain growth normally does not proceed across particle boundaries in superalloys. The maximum grain size in many cases is, therefore, limited to the original powder particle size. Grain growth across particle boundaries is most likely prevented by the precipitation of insoluble carbides on the surfaces of the particles, thus producing a barrier against grain growth. Small grain size is, therefore, generally the rule in superalloy powder products and large grain sizes are difficult to produce.

When the operating temperatures to which the completed powder metal part is subjected are below the equicohesive temperature, that is, at temperatures where the grains themselves are the weakest reagions, and many grain boundaries are desirable, small grain size with the attendant manifold grain boundaries are highly desirable. However, where the temperatures are above the equicohesive temperature, that is, at temperatures where the grain boundaries are the weakest points, large grains are necessary. In other words, at temperatures where grain boundary sliding or other grain-boundary-initiated failures become a problem, it is desirable to minimize the number of grain boundaries by grain growth. Since it is virtually impossible to remove the grain growth-inhibiting precipitates, such as the insoluble carbides in superalloys, by subsequent heat treatment to permit grain growth, powder metallurgy techniques are frequently inapplicable for fabrication of certain products designed for high temperature use, such as, for example, blades or buckets in gas turbine engines. In short, there is a grain growth problem associated with present powder metallurgy techniques in the superalloy field.

Moreover, it has been found desirable to mechanically work wrought or cast superalloy billets in order to produce an extremely fine grain size. The mechanical working, in most cases, is carried out below the normal recrystallization temperature of the material. Tensile tests on material thus processed indicate that unexpectedly high levels of ductility can be reached where the tests are carried out at or near the recrystallization temperature. 200 to 300 percent elongation are not uncommon and higher elongation values are oftentimes achieved depending on test temperatures and strain rates. This highly ductile condition is commonly referred to as "superplasticity" and permits hot forming of material at substantially reduced temperatures and pressures.

Problems are encountered, however, in achieving a condition of superplasticity in powder metal billets. In regard to superalloy powders, mechanical work is introduced by extruding the powder or powder compact into bar stock or billet form. (See for example, the U.S. Pat. No. to Moore et al 3,519,503 issued July 7, 1970.) A number of problems are associated with the extrusion method, however.

First of all, extremely high pressures must be used since the temperature of extrusion must be below the normal recrystallization temperature of the alloy. Accordingly, the maximum size billet which can be produced is limited in accordance with the capabilities of the largest extrusion equipment currently available. Presently, superplastic billets are limited to approximately six inch diameter in multiple lengths of 200 pounds each. Larger billets are required, however, to meet the needs of industry today. For example, components in gas turbine engines may weigh in excess of 400 pounds. Size limitation is, therefore, a serious drawback to the extrusion method of producing superalloy billets.

The fine grain size necessary to achieve superplasticity is produced by what is believed to be primary recrystallization of the original intra-particle grains which have been deformed during mechanical working. In other words, the deformation introduced by mechanical working facilitates creation of sites for nucleation of new grains. The amount of recrystallization, or the volumetric density of nucleation sites, is dependent upon the amount of the deformation in the crystal lattice. A frequent problem with the extrusion method is that the powder metal in some regions of the billet receives less mechanical work than others. Therefore, the density of nucleation sites varies in different parts of the billet. The result is that recrystallization is not complete across a transverse section of the billet. In short, there is a problem of homogeniety in that the percent recrystallization varies from region to region in the billet. This condition presents problems during subsequent forming since all regions of the billet do not respond the same.

Another problem encountered is temperature control. As noted above, the extrusion process is carried out near the normal recrystallization temperature of the alloy. Should this temperature be exceeded, grain growth will proceed too rapidly and the fine grain size required for superplasticity will be lost. The powder must be heated, however, to permit extrusion. The bulk of the powder is, therefore, preheated in its steel can prior to extrusion to a temperature approaching the normal recrystallization temperature. The problem is that during extrusion additional heat is produced by friction between the extrusion die and the adjacent layers of powder particles. Passage of the metal compact through the die increases the temperature of the compact above its recrystallization temperature, thereby resulting in excessive grain growth. Large size grains with inadequate plasticity are thereby produced and must be removed from the billet before further processing.

A potential problem with the extrusion method is that the mechanical working is directional resulting in a condition of anisotropy in the extruded billet.

Moreover, the superplastic billet formed by the extrusion method is not best suited for further hot forming due to its cylindrical shape. Since many of the components manufactured have relatively large width to height ratios, the cylindrical billet must be subjected to an extensive and time consuming upset operation.

Finally, the extrusion method is extremely expensive. A steel can, usually of stainless steel, is required for the initial extrusion step. Large extrusion presses capable of handling the quantities of powder required to make billets of maximum size are extremely scarce and are, of course, expensive to maintain and operate.

The search for high strength - high temperature alloys and methods for processing the same continues relentlessly as operating temperatures of engines, power plants, nuclear reactors and the like are increased. Accordingly, the need for improved methods for processing powder metals, and particularly the superalloys, to achieve superplasticity is apparent.

In regard to powder production in general, many metal powders are produced by means of the atomization process. Basically, the atomization process involves the impingement of a stream of molten metal by a high pressure fluid, normally an inert gas in the case of superalloys. The high pressure fluid breaks the stream of molten metal into small droplets which subsequently freeze. Voids can occur due to the entrapment of the atomization fluid within the particle. In other words, hollow particles are produced which later show up in the consolidated product. Abother problem encountered in atomized powder is the presence of nonmetallic inclusions. These are generally small pieces of refractory material from the tundish, nozzle, crucible, and other components of the atomization equipment which have broken off and have become mixed with the powder metal. These non-metallic inclusions also show up in the consolidated product and, along with the voids, constitute defects which can create sites for crack nucleation and propagation. These defects are particularly serious in components made of high strength, high temperature superalloys due to the susceptibility of these parts to rupture at the temperatures and stress levels encountered during service.

The instant invention provides a method for processing powder metal, for subsequent consolidation and forming into a production part, which eliminates or reduces the problems discussed hereinbefore. More specifically, dense metal compacts can be economically manufactured with an initial average grain size finer than a metal powder compact of the same composition not treated in accordance with the instant invention. In regard to superalloys, tests on nickel-base superalloys indicate that subsequent grain growth across particle boundaries can be induced by normal heat treat methods. Therefore, large grain size superalloy powder compacts can be produced. Furthermore, processing in accordance with the instant invention is capable of producing a superalloy compact having the characteristics of superplasticity, which is both homogeneous and isotropic. Hollow particles in metal powder produced by the process are effectively eliminated and nonmetallic inclusions are made innocuous or alternatively are transformed into a state which permits of easy removal from the powder metal.

Other advantages of the present invention will be readily appreciated as the same becomes better understood by reference to the following detailed description when considered in connection with the accompanying drawings wherein.

Figure 1:
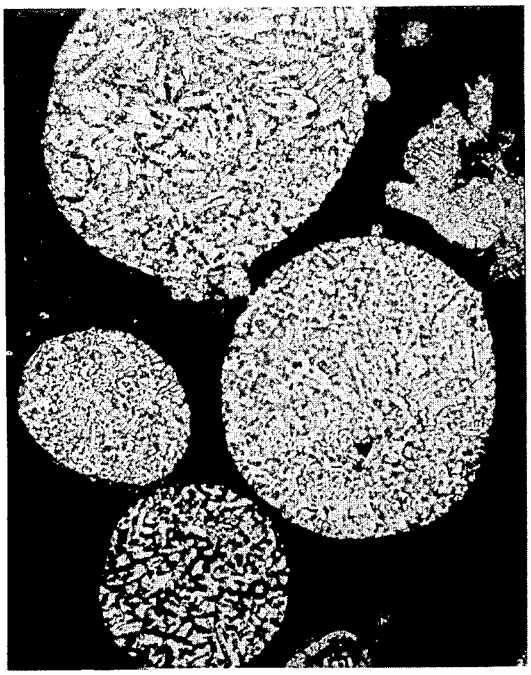
FIG. 1 is a photomicrograph of as-atomized metal particles of the powder of Table 1 at 400 X.

The magnifications to which the above descriptions of FIGS. 1 through 10 refer are the magnifications shown on the patent application drawings hereof.

The process of the instant invention basically involves forming a metal powder of a desired composition consisting of a plurality of individual metal particles by a suitable process such as, but not limited to, one of the following: atomization process, rotating electrode process, precipitation from an aqueous solution, or the electrolytic process. The powder is then plastically deformed by mechanically working each particle at a relatively low temperature; that is, the powder is cold worked to introduce strain into each particle of the loose powder to impart a residual stress to increase the potential energy level of the particles above the potential energy which the particles may have acquired during production. The powder may be mechanically worked by by any suitable method, such as, cold rolling or impacting. For example, impacting may be carried out using a centrifugal-type impact mill such as those manufactured by Vortec Products, Incorporated.

The potential energy gained by cold working, oftentimes refered to as stored strain energy, lowers the recrystallization temperature so that the deformed grains will recrystallize at a lower temperature than metal powder which has not been cold worked. The cold worked powder is then hot consolidated by any of the standard methods, such as, hot isostatic pressing, hot extrusion, hot die pressing, etc., at a temperature above the altered recrystallization temperature of the cold-worked particles, but below a temperature at which rapid grain growth occurs. This recrystallization temperature is the lowered recrystallization temperature, resulting from cold working the metal powder. Since it is desirable to retain the fine grain size existing immediately after recrystallization, the hot consolidating temperature is kept below a temperature at which excessive grain growth will occur. A specific temperature range is impossible to delineate in its broad application since some grain growth will always occur and will proceed at a rate which increases with increasing temperatures. Through routine tests, an appropriate temperature range can be selected over which excessive grain growth will not occur and the fine grain size can be retained.

It has been found that for many metal powders the resulting compact approaches its theoretical maximum density to a considerably greater extent than compacts produced with untreated powder of the same composition and that a finer grain size can be produced.

Mechanically working or cold working the loose powder by cold rolling involves deforming the particles by compression. As suggested by the term, cold rolling may be carried out in a standard rolling mill. Impacting involves propelling the particles at high velocities and causing them to impinge upon a target thereby deforming the particles. In an impact mill of the aforementioned type, the particles are propelled radially outwardly by centrifugal force by a centrally located spinning member. The area surrounding this member includes a plurality of targets which the particles strike. After the particles strike the targets they are collected by a high velocity current of gas and returned for another pass. Each time a particle strikes a target it is deformed, that is, strain is introduced which stresses the particle grains. The residual stress remains in the crystal lattice of the grains and increases the potential energy of the particles. In other words, cold work increases stored energy. Multiple passes through the impact mill cumulatively increase residual stress and consequently the amount of stored or potential energy.

When the superalloy powders are being cold worked, it is necessary to carry out the process in a non-contaminating atmosphere, such as argon in the case of the typical nickel and cobalt-base superalloys.

It is contemplated that other methods of cold working the powder may be employed, such as cold working in a ball mill, depending on the properties of the metal powder. The primary objective is to impart additional stored potential energy to the particles above the level of potential energy which the particles may have acquired during production of the metal powder. This is done by deforming the intra-particle grains. Such deformation insures extensive recrystallization during subsequent hot consolidating.

By way of example, samples of nickel-base superalloy powders atomized in an argon atmosphere having chemical compositions within the ranges listed in Table I and the sieve analysis shown in Table II were cold worked in an argon atmosphere at room temperature by passing them through the aforementioned type of impact mill for an equivalent of thirty passes.

TABLE I

| CHEMICAL ANALYSIS | |
|---|---|
| C | 0.02 - 0.15 |
| Cr | 10 - 14 |
| Co | 15 - 20 |
| Mo | 3 - 5 |
| Ti | 3 - 5 |
| Al | 4 - 6 |
| B | 0.01 - 0.02 |
| V | 0.5 - 1.0 |
| Ni | Balance |

TABLE II

| SIEVE ANALYSIS | |
|---|---|
| Mesh | % |
| +80 | 0.7 |
| −80/+100 | 9.6 |
| −100/+200 | 41.6 |
| −200/+270 | 11.3 |
| −270/+325 | 6.4 |
| −325 | 30.4 |

Hardness of the metal particles was determined on the as-atomized powder and after the 5th, 10th, 20th, and 30th passes. That the metal particles retained strain energy during plastic deformation is indicated in Table III by an average increase in hardness of the metal particles of the above-described composition.

TABLE III

| PASS NUMBER | AVERAGE HARDNESS (Rc) |
|---|---|
| As Atomized | 43 |
| 5 | 53 |
| 10 | 56 |
| 20 | 59 |
| 30 | 61 |

As would be expected, the increase in hardness for subsequent series of passes decreases as the amount of stored energy increases. In other words, the stored energy increases with increasing deformation, but at a decreasing rate.

Figure 2:
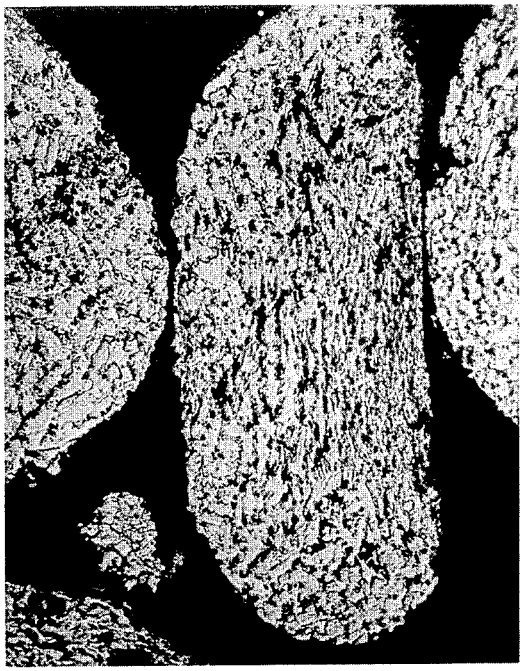
FIG. 2 is a photomicrograph of cold-rolled metal particles of the powder of Table 1 at 400 X.
Figure 3:
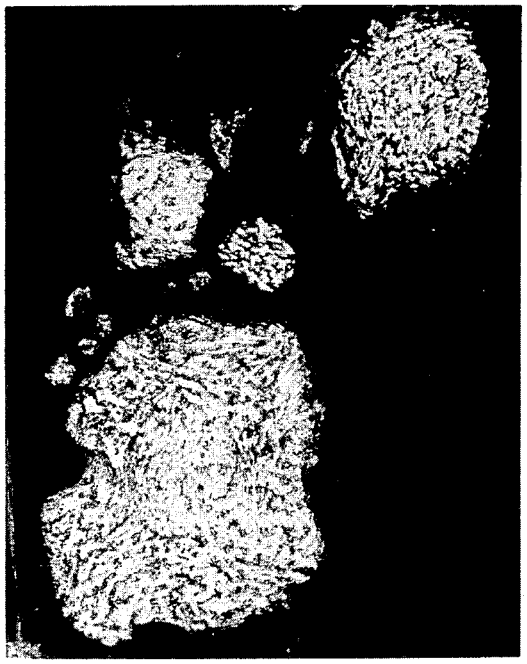
FIG. 3 is a photomicrograph of impacted metal particles of the powder of Table 1 at 400 X.

The effect of cold working the metal particles is also shown in FIGS. 1, 2, and 3. FIG. 1 is a photomicrograph of as-atomized metal particles of the powder (−100 Mesh) at 400 X. The expected dendritic structure of atomized powder is present. FIG. 2 is a photomicrograph of metal particles of the powder (−60 mesh) at 400 X which have been cold-rolled and FIG. 3 is a photomicrograph of metal particles of the powder (−100 mesh) at 400 X which has been impacted in an impact mill of the aforementioned type. That potential energy has been introduced into the metal particles shown in FIGS. 2 and 3 is evidenced by the distortion of the original particle grain structure.

Figure 4:
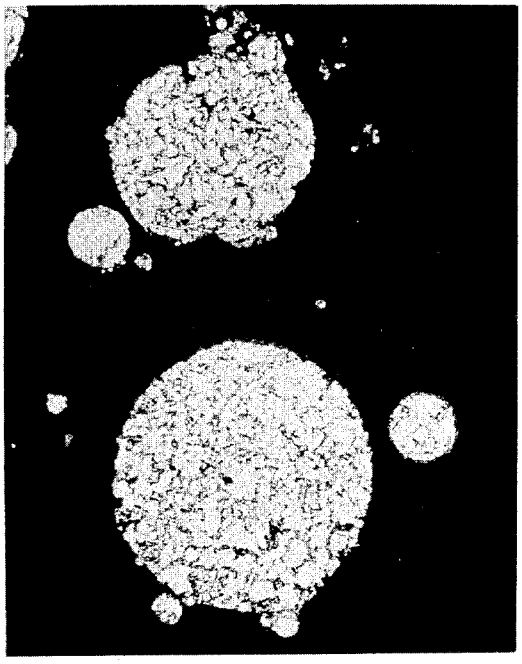
FIG. 4 is a photomicrograph of as-atomized metal particles of the powder of Table 1 vacuum heat treated at 1800° F for 1 hour at 400 X.
Figure 5:
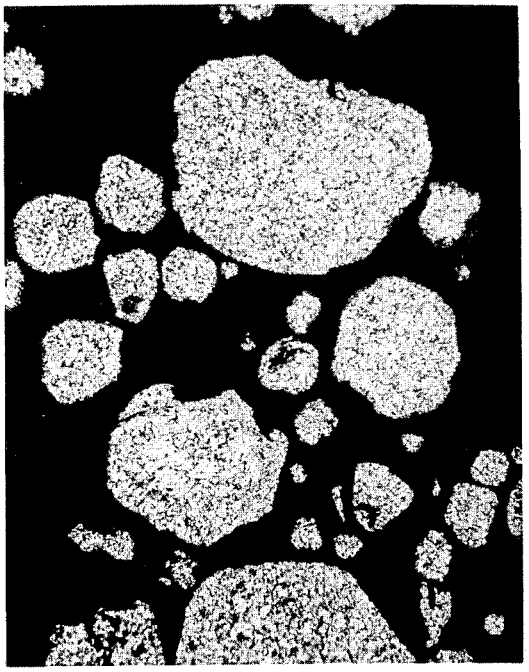
FIG. 5 is a photomicrograph of impacted metal particles of the powder of Table 1 vacuum heat treated at 1800° F for 1 hour at 400 X.

When metal powder has stored energy imparted to it, it will, upon heating for hot consolidation, recrystallize at a lower temperature than untreated powder. In other words, introducing stored energy into the individual particles of the metal powder reduces the recrystallization temperature. Furthermore, the grain size produced by recrystallization will be finer for the cold-worked metal powder than the untreated powder. FIGS. 4 and 5 are photomicrographs at 400 X which show samples of as-atomized and impacted metal powder respectively, of Table I, which have been vacuum heat treated at 1800° F for 1 hour to simulate a hot consolidation cycle.

The metal particles of the cold-worked powder shown in FIG. 5 have obviously recrystallized in view of the fine grain size and undistorted condition of the individual grains. The sample of the as-atomized, untreated metal powder shown in FIG. 4, on the other hand, has retained its original dendritic structure, indicating that recrystallization has not occured.

By following the teachings of the instant invention, it has been discovered that if sufficient stored energy is imparted to certain metal alloy powders they will, upon hot consolidation, recrystallize to a sufficiently fine grain size to render to each particle a condition of superplasticity. This allows maximum compaction to density at a lower temperature and/or lower pressure than otherwise possible. To demonstrate, samples of the cold worked nickel-base powder of Table I were loaded into borosilicate glass tubes which were evacuated and sealed from the atomosphere using conventional lampworking techniques. Samples of as-atomized metal powder were also encapsulated in the same manner. The powder metal samples were then hot isostatically compacted at 1975° F and 750 psi for two hours. Density measurements for the samples are shown in Table IV.

TABLE IV

| METAL POWDER TYPE | % OF THEORETICAL DENSITY |
|---|---|
| As-atomized | 90.9 |
| Cold Worked | 95.1 |

It is apparent from the results of the density test that a denser metal compact can be formed at a lower pressure with the cold-worked metal powder.

Alternatively, a denser compact can be formed with the cold-worked powder at lower temperatures. By way of illustration, samples of −100 mesh as-atomized metal powder and −60 mesh, cold-rolled metal powder having approximately 50% reduction in the linear dimension of the applied roll force, both having the composition shown in Table I, were encapsulated in borosilicate glass tubes as described above. The samples were then hot isostatically compacted at 1800° F and 10,000 psi for two hours. It should be noted that, heretofore, hot isostatic compacting of nickel-base superalloy powder has been carried out at temperatures exceeding 1900° F in order to produce compacts having commercially acceptable density. Moreover, the time required for the compaction process may be reduced. In short, the instant invention permits the reduction of the time, temperature, and/or pressure parameters of the known hot compaction process.

Figure 6:
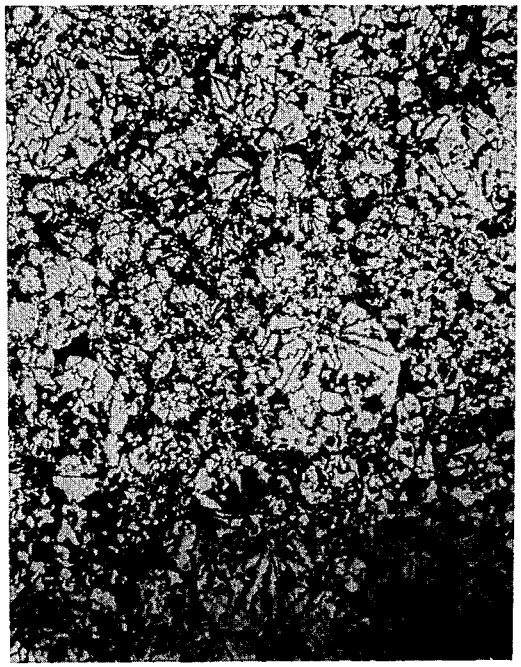
FIG. 6 is a photomicrograph of a sample of as-atomized metal powder of Table 1 which has been hot isostatically compacted at 1800° F and 10,000 psi for 2 hours at 400 X.
Figure 7:
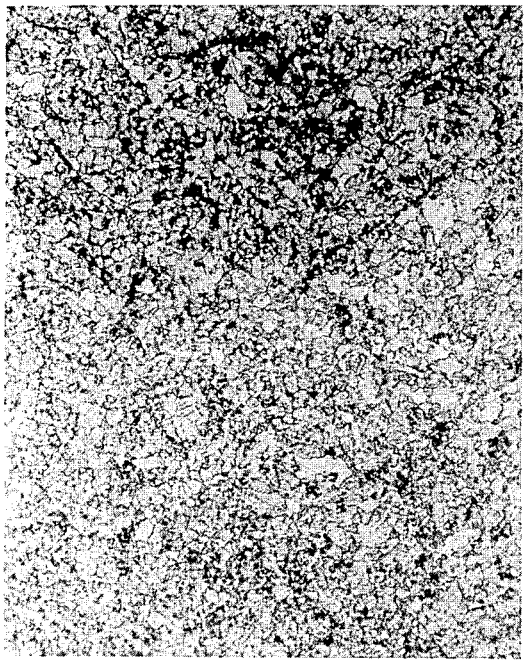
FIG. 7 is a photomicrograph of a sample of cold-rolled metal powder of Table 1 which has been hot isostatically compacted at 1800° F and 10,000 psi for 2 hours at 400 X.

FIG. 6 is a photomicrograph of the as-atomized sample at 400 X after compaction, and FIG. 7 is a photomicrograph of the cold-rolled metal powder at 400 X after compaction. Considerable porosity is evident in the as-atomized sample shown in FIG. 6, as well as a relatively course grain size of dendritic structure. It is noted that the outline of individual metal particles is still apparent. The cold-rolled sample shown in FIG. 7, on the other hand, has a fine, recrystallized grain structure. The absence of outlined original particles, or porosity is quite apparent.

Figure 8:
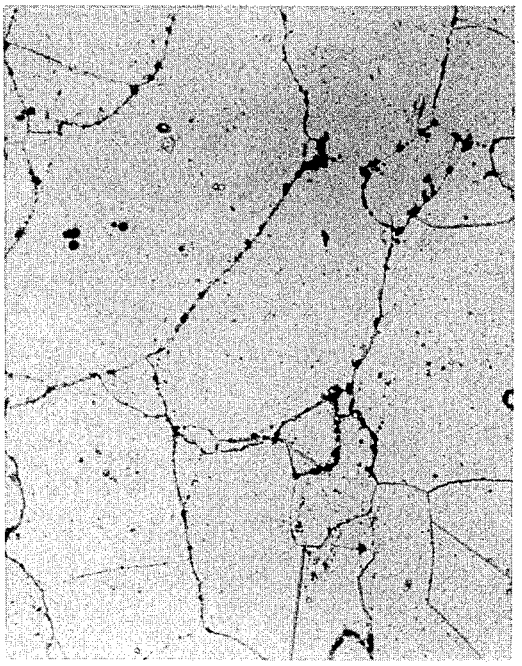
FIG. 8 is a photomicrograph of the sample of FIG. 7 which has been heat treated at 2250° for 24 hours at 400 X.

The cold-rolled sample shown in FIG. 7 was then heat treated at 2250° F for 24 hours. FIG. 8 is a photomicrograph of the heat treated sample at 400 X. FIG. 8 clearly shows that grain growth can be achieved with a nickel-base superalloy compact using standard heat treat methods. The grain size of the heat treated cold rolled sample is approximately ASTM 4 which corresponds to an 0.0035 inch average grain diameter. This grain size is substantially greater than the grain size previously achievable with as-atomized superalloy powders.

Another cold-rolled, compacted sample similar to that shown in FIG. 7 was hot isothermally forged at 2000° F using a 0.1/in./min. ram speed. The sample before forging was a 2 inch diameter by 4 inch high billet. The billet was reduced by the forging operation to a ½ inch thick pancake. The flow stresses encountered during the hot forging operation were comparable to those encountered with extruded superplastic billets of the same composition.

Figure 9:
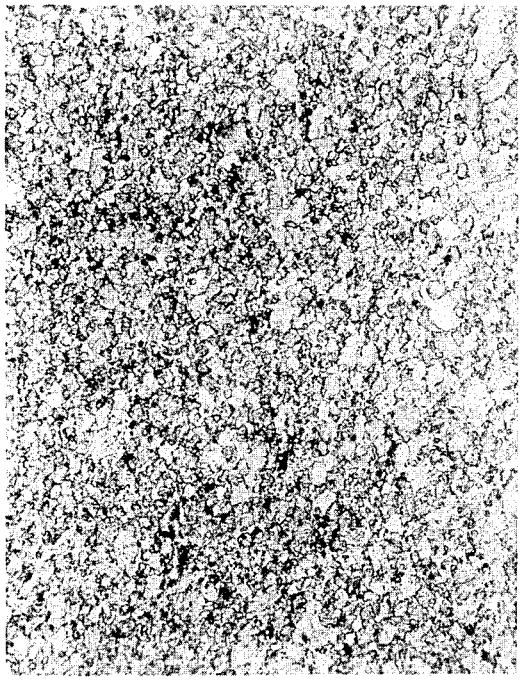
FIG. 9 is a photomicrograph of the sample of FIG. 7 which has been hot isothermally forged at 2000° F at 400 X.

FIG. 9 is a photomicrograph of the sample after hot isothermal forging. It is pointed out that the temperature employed is one at which excessive grain growth does not occur. That excessive grain growth did not occur is evident by a comparison of the compacted sample shown in FIG. 7 and the isothermally forged sample shown in FIG. 9.

Although hot isothermal forging at relatively low ram speeds is the normal procedure for hot forming superplastic billets, other hot forming procedures may also be used.

Figure 10:
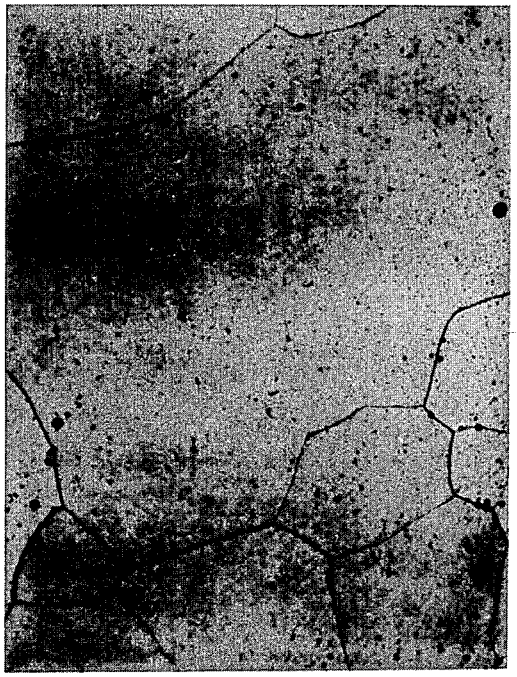
FIG. 10 is a photomicrograph of the hot isothermally forged sample of FIG. 9 which has been heat treated at 2250° F for 24 hours at 400 X.

The hot isothermally forged compact shown in FIG. 9 was then heat treated at 2250° F for 24 hours. FIG. 10 is a photomicrograph showing the results of the heat treat operation. It is particularly noted that, as with the compacted sample, grain growth can be achieved. The grain size of the heat treated isothermally forged sample shown in FIG. 10 is approximately ASTM 3. As noted above, the ability to achieve relatively large grain size is very important in the higher temperature application, turbine blades for jet engines for example, since grain boundaries are a primary source of part failure.

It is theorized by the inventor that grain growth can be achieved through standard heat treat methods because the treatment received by the metal particles, specifically, the introduction of stored energy by cold working prevents, or at least reduces, the formation of grain growth inhibiting precipitates on the surface of the particles. It is felt that this occurs for at least two reasons. First of all, it has been shown that a reduction in the hot compacting temperature is possible since dense metal compacts can be produced at lower temperatures when the metal powder is cold worked. The reduction in temperature permits hot compacting to be carried out, in most cases, over a temperature range in which deleterious precipitates do not form in harmful quantities. Deleterious precipitates are those which will not go back into solution during heat treatment. For the nickel-base superalloys, the deleterious precipitates are MC carbides where "M" is titanium. Heretofore, grain growth has been sacrificed for higher compacting temperatures since, without the higher temperatures, commercially acceptable density could not be achieved in the compacts. As stated above, with the process of the invention it is possible to lower compacting temperatures and still produce components having commercially acceptable density.

Figure 11:
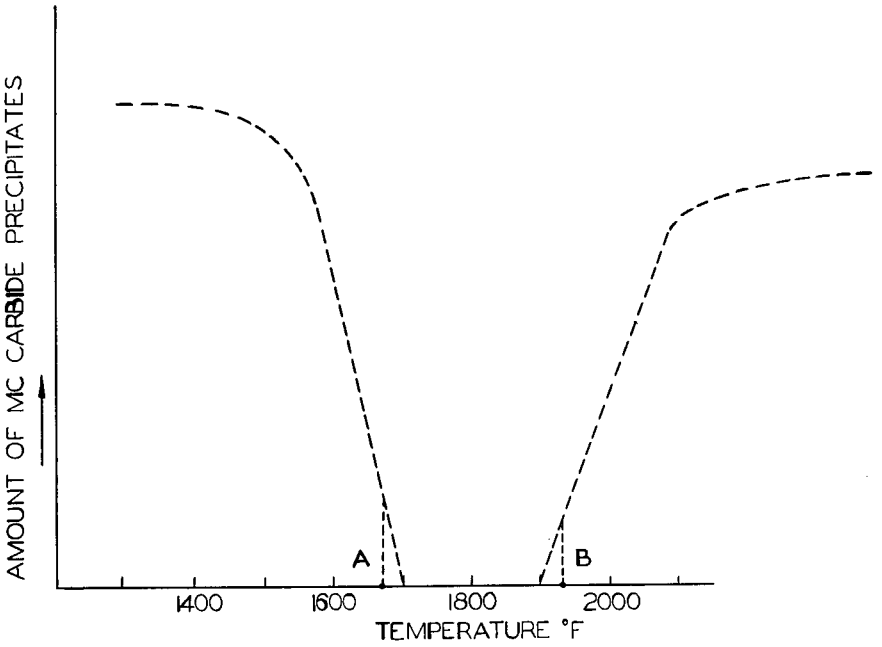
FIG. 11 is a graph showing the relationship between temperature and the amount of MC carbide precipitates which is typical for a number of nickel-base superalloys.

This phenomenon is shown in FIG. 10. Precipitation in all metals is, of course, a temperature dependant process. The MC carbide in a number of the superalloys, such as the nickel-base superalloy having the chemical composition shown in Table 1, demonstrate a reaction to temperature as typically shown in FIG. 11. Specifically, there is a temperature range over which the amount of deleterious MC carbides falls off. As suggested above, in a typical nickel-base superalloy containing both titanium and molybdenum the deleterious precipitates for this type of superalloy appear to be MC carbides where "M" is generally titanium, but in some instances molybdenum carbide may also be additionally or alternatively present. Heretofore, hot consolidation has been normally carried out at temperatures of 1975° F or greater. As mentioned above, these compacting temperatures were necessary to produce compacts having commercially acceptable density. As shown in FIG. 11, the amount of MC carbide precipitates increases rapidly at temperatures of about 1900° F and higher. The instant invention permits a reduction in the hot compaction temperature so that excessive precipitation of the deleterious phases can be avoided. Hot compacting temperatures between points A and B on the abscissa of the graph of FIG. 10 are especially beneficial to reduce the precipitation of MC carbide precipitates. Accordingly, subsequent grain growth will not be inhibited.

A second reason for increased grain growth is that the energy introduced into the crystal lattice provides sites for precipitation of the carbides within the metal particle rather than on the surface. Due to the fact that shrinkage occurs when the molten metal droplets freeze, the outer surface of the particles is in compression. This compressive stress encourages precipitation of the carbides on the surface. Increasing the internal energy of the metal particles by creating various lattice defects through cold work provides sites for the intra-particle precipitation of the carbides. Accordingly, the amount of carbides formed on the surface of the particle is reduced. A related mechanism is that the increased number of grain boundaries produced upon recrystallization of the distorted grains promotes preferential intra-particle precipitation. Precipitation at intra-particle grain boundaries requires less carbon atom migration than precipitation at the particle surface for interior carbon atoms. It is felt that intra-particle precipitation is therefore further promoted, thus preventing excessive precipitation of deleterious MC carbides at the surface. Preventing precipitation of these carbides at the surface, or at least limiting the extent thereof, permits subsequent grain growth across particle boundaries. A fully dense compact can, therefore, be produced which can be heat treated to obtain grain growth far in excess of that which is now possible with superalloy powder processing.

The problems associated with the presence of voids and nonmetallic inclusions encountered in powder metals are also eliminated, or at least alleviated to a great extent, by the process described. Porosity in compacts caused by hollow metal particles is reduced or eliminated as cold working fractures or crushes the particles.

The most effective way of eliminating hollow particles is by the impact method of cold working. In the impact method the hollow particles are broken open or fractured to expose the internal void. Accordingly, the hollow particles are eliminated.

As noted above, the nonmetallic inclusions are generally particles of refractory material which have broken off of the equipment employed in the production of the powder. In regard to the atomization process, the sources of such nonmetallic inclusions are the tundish, nozzle, crucible, and other components of the atomization equipment. As hereinbefore mentioned, nonmetallic inclusions, as well as porosity, are undesirable in the powder metal compacts because they constitute sites for crack nucleation and propogation. The problem is particularly severe in low-cycle-fatigue limited components.

The instant invention basically involves a process wherein a significant step is the introduction of energy into the individual particles of powder metal to produce a production part having superior mechanical and metallurgical properties. Since this operation is carried out on a bulk basis, the nonmetallic inclusions are also subjected to the mechanical forces required to introduce energy into the metal particles. The majority of the nonmetallic inclusions, and virtually all of the refractory material, are very brittle. Therefore, the nonmetallic inclusions are fractured or broken up and thereby reduced in size while the powder metal particles are deformed. Size reduction alone may be sufficient to render the nonmetallic inclusions innocuous since their size will be reduced below the critical flaw size necessary to initiate a crack. Alternatively, however, the nonmetallic inclusions may be removed by size separation, such as screening since a substantial size difference between the metal particles and nonmetallic inclusions has been effected by the fracturing of the latter inclusions and in may cases the resultant enlargement produced in the powder metal particles.

For example, where energy is to be imparted to metal powder by cold rolling −60/+80 mesh metal powder between pairs of rolls so that a 40 - 60% reduction in particle thickness is to be achieved, the roll gap is set to provide a 0.0039 inch clearance. Upon rolling, all metal particles are deformed into generally round platelets which are larger in two dimensions than the original, substantially spherical, particles. Nonmetallic inclusions on the other hand, being brittle, fracture and become smaller than their original size. The −60/+80 cold rolled product is than subjected to a size classification process by screening on an 80 mesh screen. The nonmetallic inclusions, now reduced in size, pass through the screen while the powder metal particles, originally −60/+80 mesh, but now larger in size, are retained on the screen. Accordingly, effective physical separation of nonmetallic inclusions from the metal powder can be made. This is the most preferable manner of removing nonmetallic inclusions.

When −60/+400 mesh metal powder is impacted to impart energy to the powder metal particles by passing it through an impact mill, nonmetallic inclusions are reduced in size due to brittle fracture. Subsequent screening through a 400 mesh screen physically removes the smaller nonmetallic inclusions from the metal powder, the particle size of which has not substantially changed.

In many instances, it should be recognized that the most significant commercial aspect of the instant invention is that it produces a highly desirable condition of superplasticity in the metal powder and production compact. A sample of nickel-base powder having the composition listed in Table I was cold-rolled to impart energy to the individual particles. The cold-worked metal powder was then hot isostatically compacted in a glass container at 1800° F and 10,000 psi for two hours to form a 2½ inch × 4 inch compact. Tensile specimens of 0.5 inch gauge length × 0.250 inch gauge diameter were prepared from transverse and longitudinal sections. Tensile tests were then conducted at 1975° F and a strain rate of 0.670 in./in./min. The results of the tensile tests are shown in Table V.

TABLE V

| Section | U.T.S. (psi) | %-Elongation |
|---|---|---|
| Transverse | 10,400 | 381 |
| Transverse | 8,830 | 294 |
| Longitudinal | 9,250 | 238 |
| Longitudinal | 8,250 | 322 |

It is apparent from the values of percent elongation that a condition of superplasticity has been achieved, particularly in view of the fact that percent elongation figures for untreated as-atomized powder of the same composition are about 20%.

Essentially there are no billet size or shape limitations comparable to those encountered in the extrusion method. A hot isostatic pressing process using a vitreous or glass container may be employed as described in the U.S. Pat. to Havel No. 3,622,313, the disclosure of which is incorporated herein by reference. The compact may be formed to almost any shape and, specifically, may be formed to a shape closely approximating that of the final product. Sophisticated shapes, such as large diameter discs and rotors, have been produced. Since hot isostatic pressing is generally carried out in an autoclave, the only size limitation involved is the maximum size work-piece which can be contained in the autoclave. Production-type powder metal compacts in excess of four hundred pounds have been produced by the hot isostatic pressing method. Due to the decrease in the required pressure, larger autoclaves can be more economically constructed for use in hot compaction since the pressure requirements are lower.

Since each particle of the metal powder is cold worked individually, all particles receive substantially the same amount of energy. Consequently, the volumetric density of nucleation sites is generally equal for each particle. On a macroscopic scale this means that the compact is generally homogeneous in terms of recrystallization. Moreover, the compact is generally isotropic.

Temperature control problems associated with the extrusion method of producing superplastic material are also eliminated because, in the instant invention, mechanical working to produce fine grain size is divorced from the compaction and sintering operation. Cold working of the metal powder is carried out at any temperature below the recrystallization temperature. For example, cold working the metal powder by impacting or cold rolling is most conveniently carried out at ambient temperatures. The extrusion method of producing superplasticity, on the other hand, requires temperatures near or above the normal recrystallization temperature of the metal to permit large reductions in cross-sectional area. Consequently, with the process of the instant invention any additional heat which may be produced during cold working is not harmful since the process is being carried out at temperatures far below those at which recovery or recrystallization and grain growth can occur.

While reference has been made throughout to hot compaction by hot isostatic pressing, it is apparent that powder metal processed according to the instant invention can be employed with all other hot compaction methods. For example, hot compaction by the extrusion method can very effectively be used. Since the powder is already at a stage in which superplasticity can be achieved by raising the temperature of the powder above the recrystallization temperature, hot extrusion can be carried out at lower pressures than would normally be required.

The invention has been described in an illustrative manner, and it is to be understood that the terminology which has been used is intended to be in the nature of words of description rather than of limitation.

In view of the above explanation of the phenomena involved in the practice of present invention, it should be recognized that a number of modifications and variations of this invention are possible. It is therefore to be understood that, within the scope of the appended claims, the invention may be practiced otherwise than as specifically described.

The embodiments of the invention in which an exclusive property or privilege is claimed are defined as follows:

1. A method for producing a substantially fully dense compact from prealloyed powder metal comprising the steps of a. providing a fully alloyed powder of predetermined composition, b. cold working the particles of the prealloyed powder metal to introduce an amount of strain equivalent to at least about a forty percent reduction in size along a major axis of the particle to thereby lower the recrystallization temperature of the powder metal, said cold working being carried out at an energy level less than that which will cause extensive brittle fracture of the particles to maintain the integrity of the particles, c. maintaining the powder metal at a temperature below the lowered recrystallization temperature until the powder is to be consolidated and thereafter d. hot consolidating the powder metal by heating the powder metal to a temperature at least slightly above the lowered recrystallization temperature to recrystallize the powder metal, but below that at which excessive grain growth occurs to maintain a relatively small grain size in the compact and by applying pressure to the heated powder metal.

2. A method as set forth in claim 1 wherein hot consolidating is carried out at a temperature at least as high as the lowered recrystallization temperature.

3. A method as set forth in claim 1 including subsequently heat treating said powder metal compact at temperatures sufficient to cause grain growth.

4. A method as set forth in claim 3 wherein said metal powder is composed of a metal selected from a group consisting of a nickel-base superalloy and a cobalt-base superalloy.

5. A method as set forth in claim 1 wherein said cold working includes deforming said particles by compressing the same between force transmitting members.

6. A method as set forth in claim 1 wherein hot consolidating is accomplished by encapsulating said metal powder in a vitreous container, heating said container and encapsulated powder to a temperature above said lowered recrystallization temperature, densifying said metal powder by applying external pressure to said container to collapse the same, and removing said collapsed container from the resultant densified metal compact.

7. A method for producing a substantially fully dense compact from prealloyed powder metal by hot consolidation wherein the powder metal and resulting compact exhibit a marked increase in hot formability comprising the steps of a. providing a fully alloyed powder of predetermined composition, b. cold working the particles of the prealloyed powder metal to introduce an amount of strain equivalent to at least about a forty percent reduction in size along a major axis of the particle to thereby lower the recrystallization temperature of the powder metal, said cold working being carried out at an energy level less than that which will cause extensive brittle fracture of the particles to maintain the integrity of the particles, c. maintaining the powder metal at a temperature below the lowered recrystallization temperature until the powder is to be consolidated and thereafter d. hot consolidating the powder metal by heating the powder metal to a temperature at least slightly above the lowered recrystallization temperature to recrystallize the powder metal, but below that at which excessive grain growth occurs to maintain a relatively small grain size in the compact and by applying pressure to the heated powder metal thereby producing a condition of high hot formability in the powder particles during consolidation which is preserved in the resulting compact to facilitate subsequent hot forming.

8. A method for producing a substantially fully dense compact from prealloyed powder metal by hot consolidation wherein the powder metal and resulting compact exhibit a marked increase in hot formability comprising the steps of a. providing a fully alloyed powder of predetermined composition, b. cold working the particles of the prealloyed powder metal to introduce an amount of strain equivalent to at least about a forty percent reduction in size along a major axis of the particles to thereby lower the recrystallization temperature of the powder metal, said cold working being carried out at an energy level less than that which will cause a reduction in the size of a significant number of individual particles, c. maintaining the powder metal at a temperature below the lowered recrystallization temperature until the powder is to be consolidated and thereafter d. hot consolidating the powder metal by heating the powder metal to a temperature at least slightly above the lowered recrystallization temperature to recrystallize the powder metal, but below that at which excessive grain growth occurs to maintain a relatively small grain size in the compact and by applying pressure to the heated powder metal thereby producing a condition of high hot formability in the powder particles during consolidation which is preserved in the resulting compact to facilitate subsequent hot forming.

* * * * *